United States Patent [19]

Aoyagi et al.

[11] Patent Number: 4,917,813

[45] Date of Patent: Apr. 17, 1990

[54] BLEACHING COMPOSITION

[75] Inventors: Muneo Aoyagi, Utsunomiya; Atsuo Nakae, Minamisaitama, both of Japan

[73] Assignee: Kao Corporation, Tokyo, Japan

[21] Appl. No.: 27,288

[22] Filed: Mar. 17, 1987

[30] Foreign Application Priority Data

Apr. 2, 1986 [JP] Japan ..... 75983

[51] Int. Cl.[4] ..... C11D 3/395; C11D 7/56

[52] U.S. Cl. ..... 252/99; 252/95; 252/135; 252/174.12; 252/174.21; 252/174.23; 252/174.24; 252/DIG. 2

[58] Field of Search ..... 252/95, 99, 135, 174.12, 252/174.21, 174.23, 174.24, DIG. 2

[56] References Cited

U.S. PATENT DOCUMENTS

| | | | |
|---|---|---|---|
| 4,079,015 | 3/1978 | Paucot et al. | 252/99 |
| 4,079,016 | 3/1978 | Brahm et al. | 252/99 |
| 4,379,061 | 4/1983 | Rabitsch et al. | 252/174.24 |
| 4,381,247 | 4/1983 | Nakagawa et al. | 252/99 |
| 4,450,089 | 5/1984 | Broze et al. | 252/95 |
| 4,686,062 | 8/1987 | Kermode et al. | 252/174.24 |

FOREIGN PATENT DOCUMENTS

| | | |
|---|---|---|
| 1804504 | 5/1970 | Fed. Rep. of Germany . |
| 3423452 | 1/1986 | Fed. Rep. of Germany . |
| 55-025435 | 2/1980 | Japan . |
| 2129456 | 5/1984 | United Kingdom . |
| 2179365 | 3/1987 | United Kingdom . |

OTHER PUBLICATIONS

Detergent Additives, Rohm & Haas Industrial Chemicals, Dec. 1981.

*Primary Examiner*—Hoa V. Le

*Attorney, Agent, or Firm*—Flynn, Thiel, Boutell & Tanis

[57] ABSTRACT

A bleaching composition comprises (a) an inorganic peroxide, (b) a nonionic surfactant and (c) a polymer of the following general formula (I), a copolymer comprising a monomer unit of the general formula (I) or a water-soluble salt thereof:

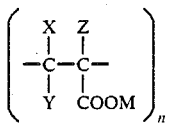

(I)

wherein X, Y and Z represent each —H, —$CH_3$, —COOM, —$CH_2$COOM or —OH, M represents H, an alkali metal or a mixture of them and n represents a number of at least 2.

5 Claims, No Drawings

BLEACHING COMPOSITION

The present invention relates to a new bleaching composition. More particularly, the invention relates to a bleaching composition comprising an inorganic peroxide, a nonionic surfactant and a specific polymer.

Various enzymatic bleaching agents comprising mainly sodium percarbonate are available on the market. Recently, compositions comprising a nonionic surfactant capable of removing oily or greasy stains in addition to sodium percarbonate having the bleaching power have been proposed.

Compositions containing such a nonionic surfactant are disclosed in the specification of Japanese Patent Laid-Open No. 25435/1980. Although these compositions are used mainly for cleaning and bleaching hard surfaces and sufficient results can be exhibited with a relatively small amount of the nonionic surfactant, a larger amount of this surfactant is necessitated when they are used as bleaching agents for clothes. In view of the fact that 70% or more of oxygen-containing bleaching agents are used together with a detergent in a washing machine it is felt that the requirement of the bleaching agents will be further increased. The compositions disclosed in said Japanese Patent Laid-Open No. 25435/1980 have, however, a defect in that the nonionic surfactant contained therein is sticky and, therefore, when it is used in an amount of about 3% or more, the physical properties of the powdery compositions are impaired seriously and the fluidity thereof is reduced. As a result, when they are used as domestic detergents, consistent weighing thereof is difficult which makes the use of them troublesome and, in addition, the bleaching agent is used frequently in an amount larger than a standard amount in such a case which causes decoloration of colored or patterned clothes.

After intensive investigations made for the purpose of overcoming the above-mentioned defects of the bleaching agents containing sodium percarbonate, the inventors have found that a bleaching composition having a high fluidity can be obtained by adding a special high-molecular polymer to an inorganic peroxide and impregnating them with a nonionic surfactant. The present invention has been completed on the basis of this finding.

The present invention provides a bleaching composition comprising (a) an inorganic peroxide, (b) a nonionic surfactant and (c) a polymer of the following general formula (I), a copolymer comprising a monomer unit of the general formula (I) or a watersoluble salt thereof:

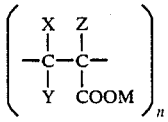

(I)

wherein X, Y and Z represent each —H, —$CH_3$, —COOM, —$CH_2$COOM or —OH, M represents H, an alkali metal or a mixture of them and n represents a number of at least 2.

It is preferable that the bleaching composition of the invention comprises 40 to 95 wt.% of (a) the inorganic peroxide, 0.1 to 10 wt.% of (b) the nonionic surfactant and 0.05 to 10 wt.% of (c) the polymer. The polymer may be defined to have repeated units having the formula (I).

The inorganic peroxide (a) used in the present invention is a compound or a mixture of compounds selected from the group consisting of percarbonates, perborates, Glauber's salt/common salt / $H_2O_2$ adducts, urea/$H_2O_2$/gypsum adducts and $2KHSO_5 \cdot K_2SO_4 \cdot KHSO_4$. Among them, sodium percarbonate is preferred.

Usually, sodium percarbonate having the formula: $2Na_2CO_3 \cdot 3H_2O_2$ is obtained by reacting sodium carbonate with an aqueous hydrogen peroxide solution. Sodium percarbonate obtained by said reaction, followed by crystallization, dehydration and drying, is pulverized alone or together with, for example, a binder, if necessary, to form a powder having a particle diameter of 100 to 5 mesh.

The inorganic peroxide is used in an amount of preferably 40 to 95 wt. %.

The nonionic surfactants (b) used in the present invention include polyoxyethylene alkyl ethers and polyoxyethylene alkylphenyl ethers. The polyoxyethylene alkyl ethers are those having an alkyl or alkenyl group having 10 to 18 carbon atoms on average and 1 to 20 mol of ethylene oxide added and polyoxyethylene alkylphenyl ethers are those having an alkyl group having 6 to 12 carbon atoms on average and 1 to 20 mol of ethylene oxide added. The nonionic surfactant is used in an amount of preferably 0.1 to 10 wt. %.

The components (c) used in the present invention include polymers of the above general formula (I) in which the monomer unit is acrylic, methacrylic, fumaric, maleic, aconitic, itaconic, 2-hydroxyacrylic or citraconic acid and their alkali metal salts as well as copolymers of one or more compounds selected from the group consisting of ethylene, vinyl acetate, vinylpyrrolidone, methylvinylpyrrolidone, methyl vinyl ether, styrene, pentene, isobutylene, diisobutylene and butadiene with a monomer unit of the general formula (I) and their water-soluble salts. The molecular weights of these polymers, copolymers and water-soluble salts of them are preferably 200 to 100,000, particularly 500 to 50,000. The amount of the component (c) used is preferably 0.5 to 10%.

Among various processes for the addition of the component (c) and the nonionic surfactant, the following processes are suitable for the present invention: a process wherein sodium percarbonate, obtained by reacting sodium carbonate with an aqueous hydrogen peroxide solution and then crystallizing the reaction product, is dehydrated, then the component (c) in the form of a powder or aqueous solution thereof is added thereto and the obtained mixture is dried and mixed with the nonionic surfactant, a process wherein an aqueous solution of the component (c) is added to powdery or granular dry sodium percarbonate, and the mixture is dried and mixed with the nonionic surfactant, and a process wherein the component (c) in the form of powder or an aqueous solution thereof and the nonionic surfactant are added to dry sodium percarbonate powder or crystallized, dehydrated but non-dried sodium percarbonate and the mixture is granulated together with a binder.

In the above-mentioned processes, other organic and inorganic components may be incorporated therein, if necessary.

The suitable size of these powdery particles or granules is 100 to 5 mesh.

A protease can be incorporated in the bleaching agent. The stability of the enzyme in the bleaching agent is far higher than that in a conventional composition comprising only sodium percarbonate and a nonionic surfactant and, particularly, the storage stability in an atmosphere having a high humidity is improved. The improvement of the stability is quite significant, since the bleaching composition is stored and used usually in a place of a high humidity. The protease granules used in the present invention are, for example, alkaline protease.

Examples of the commercially available enzyme products include "Alcalase", "Esperase" and "Sabinase" (products of Novo Industry Co., Copenhagen, Denmark), "Maxatase-P" (a product of Gist-Brocades N. V., Delft, Netherland), "Protease B-400", "Protease B-4000", "Protease Ap" and "Protease Ap 100" (products of Schweizerische Ferment A. G., Basle, Switzerland), "GRD Protease" (a product of Monsanto Co., St. Louis, Mo., U.S.A.) and "API-21" (Showa Denko K. K.).

The proteases are used in an amount of preferably 0.05 to 5 wt. %.

The bleaching composition of the present invention may contain, in addition to the above-mentioned components, known bleaching components, if necessary. They include inorganic and organic builder components such as sodium tripolyphosphate, sodium carbonate, sodium pyrophosphate, sodium sulfate, sodium borate, sodium hydrogencarbonate, sodium silicate, sodium nitrilotriacetate and sodium ethylenediaminetetraacetate; high-molecular substances such as carboxymethylcellulose, polyvinyl alcohol and polyethylene glycol; flavors; pigments; fluorescent dyes; activators; etc. The bleaching composition can be used in combination with a detergent composition.

EXAMPLES

The following examples will further illustrate the present invention. Bleaching compositions 1 to 13 of the present invention comprising components shown in Table 1 and comparative samples A and B were prepared and subjected to the following tests:

(1) Fluidity of the composition:

The angle of repose was determined with a powder tester (a product of Hosokawa Micron Co., Ltd.).

(2)Storage stability of enzyme:

10 g of each sample was placed in a 50-ml plastic vessel having an air vent, which was stored in a constant-temperature room kept at 40° C. and 80% RH for 20 days. The enzymatic activities of the samples were determined before and after the storage and the residual enzymatic activity was calculated according to the following formula:

$$\text{residual enzymatic activity (\%)} = \frac{\text{enzymatic activity after storage}}{\text{enzymatic activity before storage}} \times 100$$

| | | Present invention | | | | | | | | | | | | | Comparative | |
|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | A | B |
| Components (wt. %) | | | | | | | | | | | | | | | | |
| Sodium percarbonate | | 80 | 80 | 80 | 80 | 80 | 80 | 80 | 80 | 80 | 80 | 80 | 80 | 80 | 80 | 80 |
| Sodium carbonate | | 16 | 14.5 | 12 | 16 | 14.5 | 12 | 16 | 14.5 | 12 | 16 | 14.5 | 12 | 15.5 | 17 | 17 |
| Alcalase 2.0T | | 1.0 | 1.0 | 1.0 | 1.0 | 1.0 | 1.0 | 1.0 | 1.0 | 1.0 | 1.0 | 1.0 | 1.0 | — | 1.0 | 1.0 |
| Nonionic surfactant | Polyoxyethylene dodecyl ether (EO 12 mol) | 2.0 | 2.0 | 2.0 | 2.0 | 2.0 | 2.0 | — | — | — | — | — | — | 2.0 | 2.0 | — |
| | Polyoxyethylene nonylphenyl ether (EO 11 mol) | — | — | — | — | — | — | 2.0 | 2.0 | 2.0 | 2.0 | 2.0 | 2.0 | — | — | 2.0 |
| Component (c) | Sodium polyacrylate ($\overline{MW}$ = 8000) | 1.0 | 2.5 | 5.0 | — | — | — | 1.0 | 2.5 | 5.0 | — | — | — | 2.5 | — | — |
| | Sodium salt of hydrolyzate of pentene/maleic anhydride copolymer ($\overline{MW}$ = 4,000) | — | — | — | 1.0 | 2.5 | 5.0 | — | — | — | 1.0 | 2.5 | 5.0 | — | — | — |
| Test results | | | | | | | | | | | | | | | | |
| Angle or repose (degree) | | 43 | 42.5 | 42.5 | 43 | 43 | 42.5 | 43 | 43 | 43 | 42.5 | 42.5 | 43 | 43 | 47 | 46.5 |
| Residual enzymatic activity (%) | | 70 | 73 | 80 | 71 | 74 | 79 | 71 | 73 | 79 | 69 | 73 | 78 | — | 59 | 57 |

What is claimed is:

1. A bleaching composition consisting essentially of
(a) 80 to 95 wt.% of an inorganic peroxide bleaching agent selected from the group consisting of percarbonates and perborates;
(b) 0.1 to 10 wt.% of an nonionic surfactant;
(c) 0.05 to 10 wt.% of a polymer of acrylic acid and water-soluble salts of said polymer, said polymer having a molecular weight of 500 to 50,000;
(d) 0.05 to 5 wt.% of a protease; and
(e) one or more members of inorganic and organic builder components selected from the group consisting of sodium tripolyphosphate, sodium carbonate, sodium pyrophosphate, sodium sulfate, sodium borate, sodium hydrogen carbonate, sodium silicate, sodium nitrilotriacetate and sodium ethylenediaminetetraacetate.

2. The bleaching composition of claim 1, in which said bleaching agent is sodium percarbonate and said nonionic surfactant is selected from the group consisting of (1) polyoxyethylene alkyl or alkyenyl ethers wherein said alkyl or alkenyl has 10 to 18 carbon atoms and which contains 1 to 20 moles of ethylene oxide, and (2) polyoxyethylene alkylphenyl or alkenylphenyl ethers in which said alkyl or alkenyl has 6 to 12 carbon atoms and which contains 1 to 20 moles of ethylene oxide.

3. The bleaching composition of claim 1, consisting essentially of
(a) 80 wt.% of sodium percarbonate;

(b) 2 wt.% of a nonionic surfactant selected from the group consisting of polyoxyethylene dodecyl ether containing 12 moles of ethylene oxide and polyoxyethylene nonylphenyl ether containing 11 moles of ethylene oxide;

(c) from 1.0 to 5.0 wt.% of said polymer;

(d) 1.0 wt.% of said protease; and (e) from 12 to 16 wt.% of sodium carbonate.

4. A bleaching composition consisting essentially of (a) 80 to 95 wt.% of an inorganic peroxide bleaching agent selected from the group consisting of percarbonates and perborates;

(b) 0.1 to 10 wt.% of a nonionic surfactant;

(c) 0.05 to 10 wt.% of a polymer of acrylic acid and water soluble salts of said polymer, said polymer having a molecular weight of 500 to 50,000;

(d) 0.05 to 5 wt.% of a protease; and (e) one or more members of inorganic and organic builder components selected from the group consisting of sodium tripolyphosphate, sodium carbonate, sodium pyrophosphate, sodium sulfate, sodium borate, sodium hydrogen carbonate, sodium silicate, sodium nitrilotriacetate and sodium ethylenediaminetetraacetate; and (f) a high-molecular weight substance selected from the group consisting of carboxymethylcellulose, polyvinyl alcohol and polyethylene glycol.

5. A bleaching composition consisting of (a) 80 wt.% of sodium percarbonate;

(b) 2 wt.% of polyoxyethylene dodecyl ether containing 12 moles of ethylene oxide;

(c) 5 wt.% of sodium polyacrylate, said sodium polyacrylate having a molecular weight of 8,000;

(d) 1 wt.% of a protease; and (e) 12 wt.% of sodium carbonate.

* * * * *